US008162712B1

(12) United States Patent
Uy

(10) Patent No.: US 8,162,712 B1
(45) Date of Patent: Apr. 24, 2012

(54) PERSONALIZED DOLL KIT WITH COMPUTER GENERATED PHOTOGRAPH FACE

(76) Inventor: Patricia L. Uy, Hicksville, NY (US)

( * ) Notice: Subject to any disclaimer, the term of this patent is extended or adjusted under 35 U.S.C. 154(b) by 404 days.

(21) Appl. No.: 12/587,969

(22) Filed: Oct. 15, 2009

(51) Int. Cl.
*A63H 3/02* (2006.01)

(52) U.S. Cl. ..... 446/369; 446/391; 446/372; 446/321

(58) Field of Classification Search ..... 446/369–372, 446/231, 385, 391; 101/485–486; 40/777, 40/768, 725; 430/256; 24/113 R; *A63H 3/02*
See application file for complete search history.

(56) References Cited

U.S. PATENT DOCUMENTS

| | | | | | |
|---|---|---|---|---|---|
| 833,448 | A | * | 10/1906 | De Vall | 430/496 |
| 2,199,049 | A | | 4/1940 | Greenberg | |
| 4,020,586 | A | * | 5/1977 | Benner | 446/394 |
| 4,573,927 | A | * | 3/1986 | Newman | 434/236 |
| 4,659,319 | A | | 4/1987 | Blair | |
| 4,929,213 | A | * | 5/1990 | Morgan | 446/97 |
| 4,966,815 | A | * | 10/1990 | Hare | 428/497 |
| 4,993,987 | A | | 2/1991 | Hull et al. | |
| 5,009,626 | A | * | 4/1991 | Katz | 446/391 |
| 5,141,466 | A | * | 8/1992 | Catizone | 446/391 |
| 5,314,370 | A | * | 5/1994 | Flint | 446/391 |
| 5,382,187 | A | | 1/1995 | Wilson | |
| 5,403,224 | A | | 4/1995 | Gintling | |
| 5,515,592 | A | * | 5/1996 | Mills | 29/412 |
| 5,676,584 | A | * | 10/1997 | Perryman | 446/321 |
| 5,803,788 | A | * | 9/1998 | Penberthy et al. | 446/391 |
| 5,848,900 | A | * | 12/1998 | Pearson | 434/236 |
| 5,906,005 | A | * | 5/1999 | Niskala et al. | 2/206 |
| 5,943,698 | A | * | 8/1999 | Blanks | 2/69 |
| 5,947,791 | A | * | 9/1999 | Taylor | 446/321 |
| 6,050,875 | A | * | 4/2000 | Lee | 446/391 |
| 6,099,378 | A | | 8/2000 | George et al. | |
| 6,106,360 | A | * | 8/2000 | Jenkins et al. | 446/369 |
| 6,183,338 | B1 | * | 2/2001 | Mallette | 446/337 |
| 6,423,466 | B2 | * | 7/2002 | Hare et al. | 430/263 |
| D466,565 | S | * | 12/2002 | Borgaro et al. | D21/577 |
| 6,491,565 | B1 | | 12/2002 | McCullough | |
| 6,511,359 | B1 | * | 1/2003 | Lui | 446/321 |
| 6,810,611 | B2 | * | 11/2004 | Yarnall | 40/411 |
| 6,945,841 | B2 | * | 9/2005 | Becker et al. | 446/100 |
| 8,070,553 | B2 | * | 12/2011 | Carnegie | 446/369 |
| 2003/0145501 | A1 | * | 8/2003 | Yarnall | 40/725 |

(Continued)

FOREIGN PATENT DOCUMENTS

GB 2013508 A * 8/1979

(Continued)

*Primary Examiner* — Gene Kim
*Assistant Examiner* — Matthew B Stanczak
(74) *Attorney, Agent, or Firm* — Richard L. Miller

(57) ABSTRACT

A personalized doll kit with computer generated photograph face which comprises a transfer paper having the computer generated photograph face printed in a mirror image thereon which is transferred to a piece of fabric by ironing. An interface sheet has a large circle and a concentric inner small circle. The transfer paper, fabric, and a padding member are stacked to form a face assembly. The face assembly is secured together at the large circle of the interface sheet. Excess material of the face assembly is cut away from a stitch line at the large circle, while the inner small circle is removed to form a circular aperture to expose the photograph face. By manually urging the bottom of the padding member upwardly the photograph face on the transfer paper on the piece of fabric will go through the circular aperture on the interface sheet to reverse the interface sheet.

8 Claims, 5 Drawing Sheets

U.S. PATENT DOCUMENTS

| | | | | |
|---|---|---|---|---|
| 2003/0150149 | A1* | 8/2003 | Quick | 40/725 |
| 2003/0236050 | A1* | 12/2003 | Landry | 446/369 |
| 2004/0077274 | A1* | 4/2004 | Becker et al. | 446/268 |
| 2008/0156215 | A1* | 7/2008 | Atkins | 101/493 |
| 2010/0075569 | A1* | 3/2010 | Carnegie | 446/268 |

FOREIGN PATENT DOCUMENTS

| | | | |
|---|---|---|---|
| JP | 2003-284872 | A * | 10/2003 |
| JP | 2004-261620 | A * | 9/2004 |
| JP | 2008-167848 | A * | 7/2008 |

* cited by examiner

PERSONALIZED DOLL KIT WITH COMPUTER GENERATED PHOTOGRAPH FACE

BACKGROUND OF THE INVENTION

1. Field of the Invention

The present invention relates to a doll, and more particularly, a personalized doll kit with computer generated photograph face.

2. Description of the Prior Art

Numerous innovations for dolls having fabricated faces have been provided in the prior art that will be described. Even though these innovations may be suitable for the specific individual purposes to which they address, however, they differ from the present invention.

A FIRST EXAMPLE, U.S. Pat. No. 2,199,049, Issued on Apr. 30, 1940, to Greenberg teaches a doll provided with interchangeable faces comprising a head portion made in the general form of the head of a human and having an enlarged and relatively flat front portion, the front portion being plain but slightly convex for forming a blank face portion for the head, a flexible member having the representation of a human face on its front and means for detachably holding the flexible member in close contact with the front portion of the head, the means for holding the flexible member to the head comprising a substantially oval rib at the periphery of the face portion with a slot in its top portion for receiving the flexible member and the rib having an internal channel for receiving portions of the flexible member, the inner wall of the channel and the inner wall of the slot forming continuation of the face portion of the head.

A SECOND EXAMPLE, U.S. Pat. No. 4,659,319, Issued on Apr. 21, 1987, to Blair teaches a three-dimensional image, which can be the face of a person, or other image having: a base, a picture module formed of flexible picture material bearing thereon a picture-making coating which latter is imprinted thereon in duplication from a photograph by known methods, the picture-module being attached to the forward side of the base and such forward side having a shape complementary to the picture coating as is accomplished by the method of this invention which is sculpting the material which makes the forward side of the base while such material is flexible and before heating it, the shaping of the moldable material being done by pressure exerted on and through the module as guided visually by the picture-making coating which latter can be accomplished by human sculpturing skill whereby the picture module is also sculpted into a new shape and complementary to the sculpted base. An alternative to the use of moldable and bakable material being to form the shape of the face by use of stitching to gather into protruding portions a stitchable flexible material, such stitching being done through such a module with its picture-coating as the guide. The image can be the face of a being having a voice and a voice-recording player assembly can be mounted on the face image which contain the voice of the same being. The face image can be made from three photographs taken from the front, right and left sides and lapped to register with one another at the corners of the respective eyes whereby not only the front but the sides of the picture module become sculpted.

A THIRD EXAMPLE, U.S. Pat. No. 4,993,987, Issued on Feb. 19, 1991, to Hull et al. teaches a doll having a personalized, photographic face such as mother's face, impregnated in the material of which the doll is constructed.

A FOURTH EXAMPLE, U.S. Pat. No. 5,382,187, Issued on Jan. 17, 1995, to Wilson teaches a specially designed doll that could accept the transfer of a computer portrait directly on its face without wrinkling. The face of the doll is shaped similar to a real face and cut out on the straight of the material to ensure that it does not stretch or wrinkle. The panels forming the sides of the head are cut on the bias of the material in order to stretch with the pressure of the heat press but not affect the face area. This allows the face to remain flat so that the picture does not wrinkle and the result is a clear picture.

A FIFTH EXAMPLE, U.S. Pat. No. 5,403,224, Issued on Apr. 4, 1995, to Jintling teaches a doll having a pocket secured to the face portion of the doll for displaying a photograph. The doll includes a doll body and a doll head with a pocket which may include a releasable sealing closure such that the photograph may be sealed within the pocket. Releasable fabric fasteners may be utilized to secure the pocket to the face portion, whereby the pocket may be selectively removed to facilitate both a reversing of the pocket and a washing of the doll or the like.

A SIXTH EXAMPLE, U.S. Pat. No. 6,099,378, Issued on Aug. 8, 2000, to George et al. teaches a system and method for producing realistic doll heads that have the facial appearance of particular children. The customer, using ten facial characteristics set forth in a chart, selects from among a predetermined number of facial characteristics those most closely resembling the facial appearance of the child. The facial characteristics that are selected comprise seven face shapes (rounded, oval, pear, rectangular, thinner rectangular, thinner heart, and wider heart); skin tone; eye color; eyelash color; eyebrow color, thickness, and shape; hair color, cut, length, and style; and birthmarks, moles, and/or freckles. The selected characteristics are then applied to the doll head to produce a one-of-a-kind doll closely resembling the child.

A SEVENTH EXAMPLE, U.S. Pat. No. 6,491,565, Issued on Dec. 10, 2002, to McCullough teaches a personalized doll system which includes a picture of the face and upper torso of an individual; and a doll with a head, a neck, a torso, two arms including two hands and two legs including two feet, the head including two eyes, a nose, a mouth and hair, the torso including a dress and an apron, the legs including two shoes, each shoe including a base portion and an ankle strap, in an operative orientation a user taking a Polaroid photograph, and fabricating a doll with the characteristics of the individual.

It is apparent now that numerous innovations for dolls having fabricated faces have been provided in the prior art that adequate for various purposes. Furthermore, even though these innovations may be suitable for the specific individual purposes to which they address, accordingly, they would not be suitable for the purposes of the present invention as heretofore described.

SUMMARY OF THE INVENTION

AN OBJECT of the present invention is to provide a personalized doll kit with computer generated photograph face that avoids the disadvantages of the prior art.

ANOTHER OBJECT of the present invention is to provide a personalized doll kit with computer generated photograph face that is simple and inexpensive to manufacture.

STILL ANOTHER OBJECT of the present invention is to provide a personalized doll kit with computer generated photograph face that is simple to use.

BRIEFLY STATED, STILL YET ANOTHER OBJECT of the present invention is to provide a personalized doll kit with computer generated photograph face which comprises a transfer paper having the computer generated photograph face printed in a mirror image thereon. A piece of fabric has the transfer paper with the photograph face ironed thereon. An interface sheet has a large circle and a concentric inner small circle formed thereon. A padding member is provided. The piece of fabric has the transfer paper with the photograph face stacked upon the padding member for form a face assembly. A mechanism is for securing the face assembly together using the large circle on the interface sheet as a guide. Excess material of the face assembly is cut away from a stitch line on the interface sheet, while a small disc is removed from along the inner small circle to form a circular aperture to expose the photograph face. By manually urging the bottom of the padding member upwardly the photograph face on the transfer paper on the piece of fabric will go through the circular aperture on the interface sheet to reverse the interface sheet. A doll body has a head with a blank face. A mechanism is for sewing the cutaway face assembly with the exposed photograph face to the blank face on the head of the doll body.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawings are briefly described as follows.

A MARSHALING OF REFERENCE NUMERALS UTILIZED IN THE DRAWING

Figure 1:
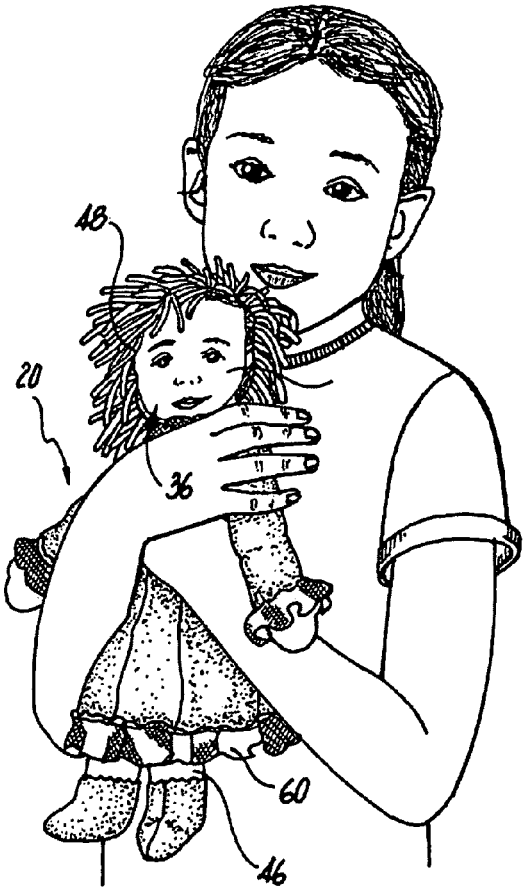
FIG. 1 is a diagrammatic perspective view of an embodiment of the present invention being held by a child whose face is represented by a photograph on the doll.
Figure 2:
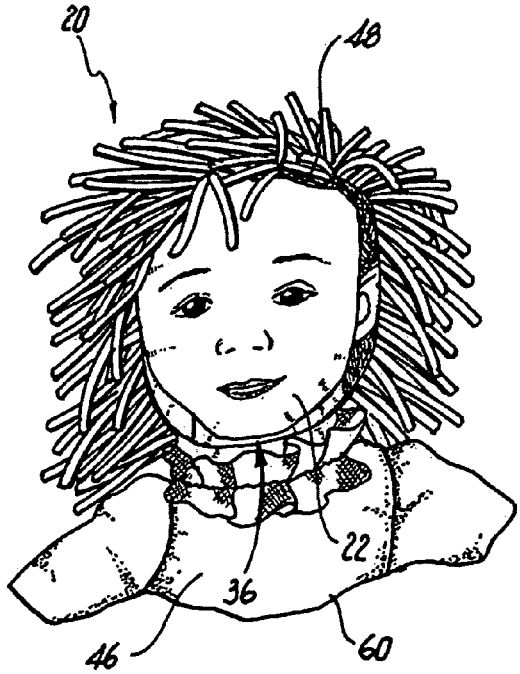
FIG. 2 is an enlarged diagrammatic perspective view showing an upper body portion of the doll with the face assembly attached thereto in greater detail.
Figure 3:
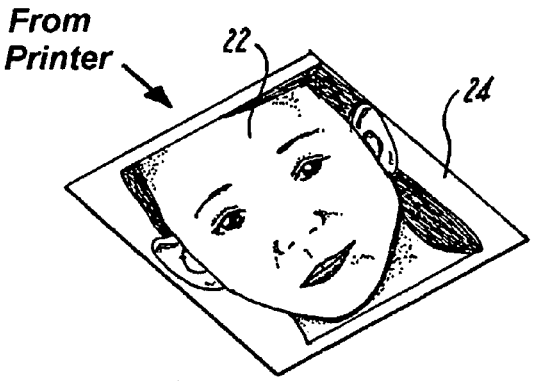
FIG. 3 is a diagrammatic perspective view showing a photograph face printed in a mirror image onto a transfer paper.
Figure 4:
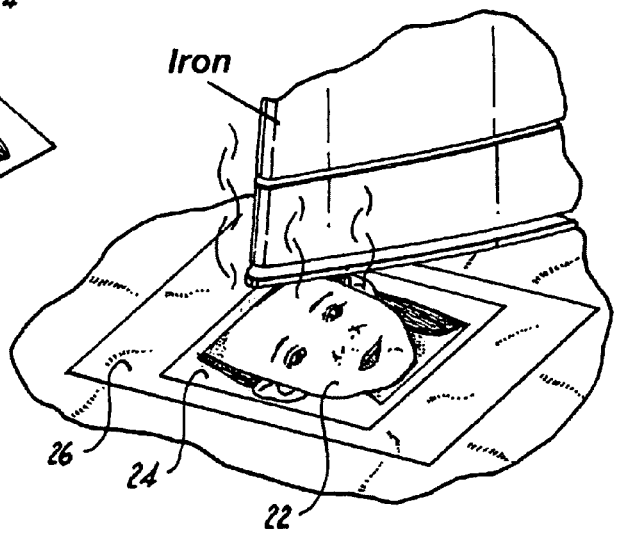
FIG. 4 is a diagrammatic perspective view showing the transfer paper with the photograph face being ironed onto a piece of fabric.
Figure 5:
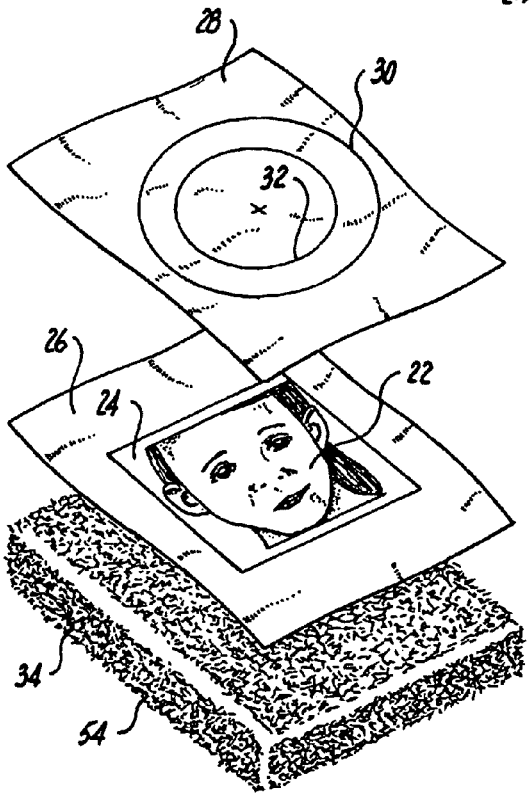
FIG. 5 is a diagrammatic perspective view showing components of the face assembly ready to be assembled.
Figure 6:
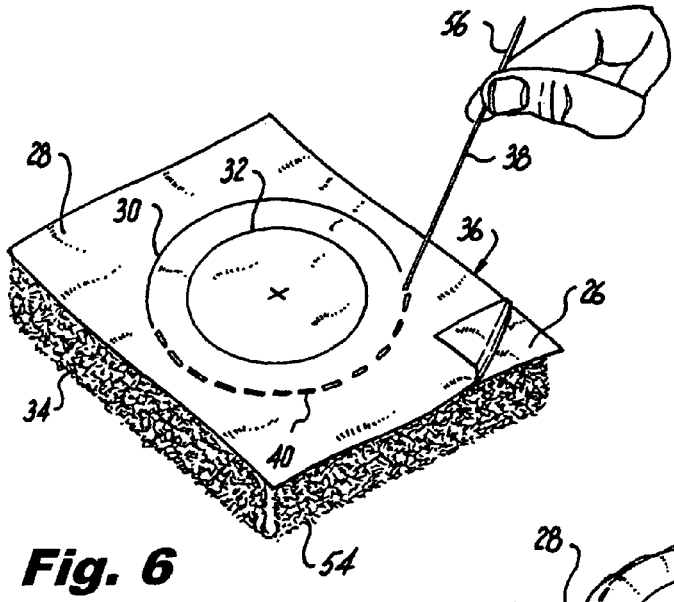
FIG. 6 is a diagrammatic perspective view showing the components of the face assembly being sewn together.
Figure 7:
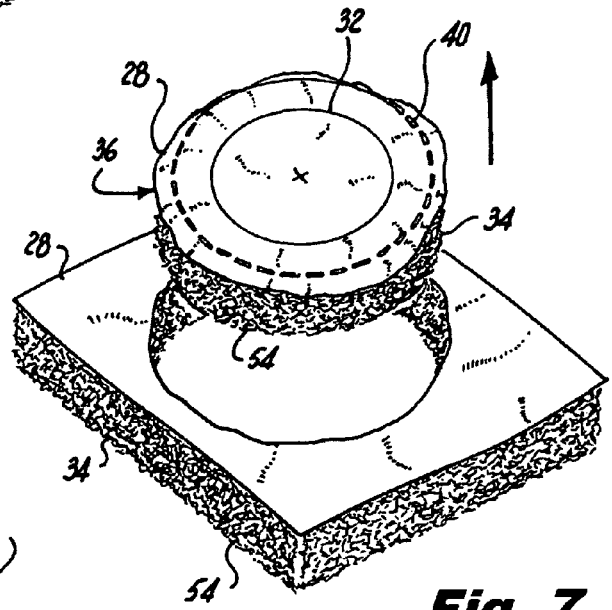
FIG. 7 is a diagrammatic perspective view showing a central portion of the face assembly that is cut away being removed therefrom.
Figure 8:
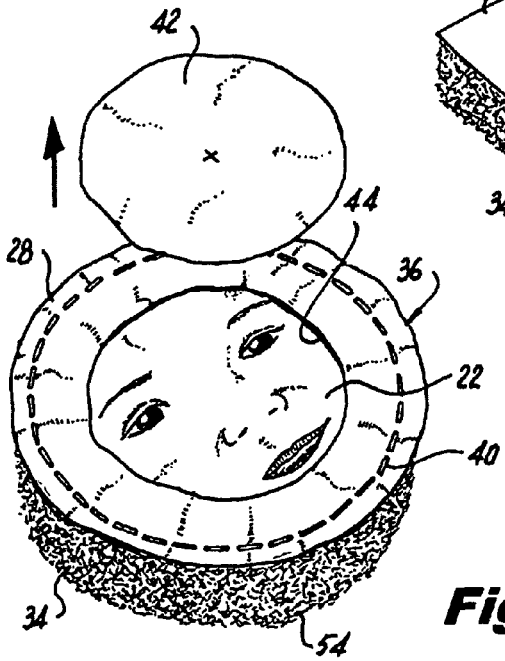
FIG. 8 is a diagrammatic perspective view showing a small disc on the interface sheet being removed to expose the photograph face.
Figure 9:
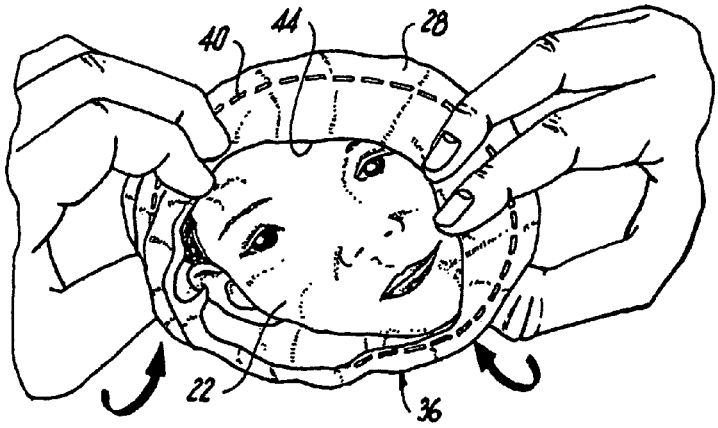
FIG. 9 is a diagrammatic perspective view showing the interface sheet being manually reversed.
Figure 10:
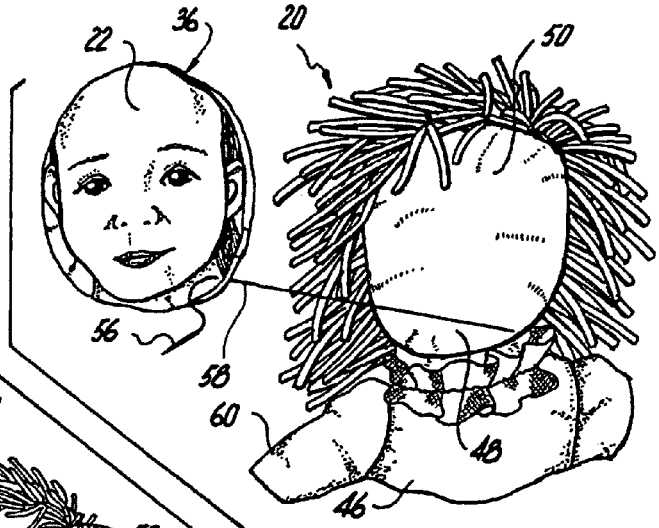
FIG. 10 is a diagrammatic perspective view showing the face assembly being sewn to a blank face on a head of a doll body.

20 personalized doll
22 photograph face of personalized doll 20
24 transfer paper of personalized doll 20
26 piece of fabric of personalized doll 20
28 interface sheet of personalized doll 20
30 large circle on interface sheet 28
32 small circle on interface sheet 28
34 padding member of personalized doll 20
36 face assembly of personalized doll 20
38 first securing mechanism of personalized doll 20
40 stitch line on interface sheet 28
42 small disc from interface sheet 28
44 circular aperture in interface sheet 28
46 doll body of personalized doll 20
48 head of doll body 46
50 blank face on head 48
52 second securing mechanism of personalized doll 20
54 DACRON material for padding member 34
56 needle of first securing mechanism 38 and second securing mechanism 52
58 thread of first securing mechanism 38 and second securing mechanism 52
60 soft cloth padded composition of doll body 46
62 set of instructions for personalized doll 20
64 box for personalized doll kit
66 kit of personalized doll 20

DETAILED DESCRIPTION OF THE PREFERRED EMBODIMENT

Referring now to the figures, in which like numerals indicate like parts, and particularly to FIGS. 1 through 12, which are a diagrammatic perspective view of an embodiment of the present invention being held by a child whose face is represented by a photograph on the doll; an enlarged diagrammatic perspective view showing an upper body portion of the doll with the face assembly attached thereto in greater detail; a diagrammatic perspective view showing a photograph face printed in a mirror image onto a transfer paper; a diagrammatic perspective view showing the transfer paper with the photograph face being ironed onto a piece of fabric; a diagrammatic perspective view showing components of the face assembly ready to be assembled; a diagrammatic perspective view showing the components of the face assembly being sewn together; a diagrammatic perspective view showing a central portion of the face assembly that is cut away being removed therefrom; a diagrammatic perspective view showing a small disc on the interface sheet being removed to expose the photograph face; a diagrammatic perspective view showing the interface sheet being manually reversed; a diagrammatic perspective view showing the face assembly being sewn to a blank face on a head of a doll body; an exploded diagrammatic perspective view showing the various components of the present invention ready to be placed within a box for distribution as a kit; and a flow chart diagram showing the various steps taken for assembling the present invention, and as such, will be discussed with reference thereto.

The present invention is a personalized doll kit 66 with computer generated photograph face 22 which comprises a transfer paper 24 having the computer generated photograph face 22 printed in a mirror image thereon. A piece of fabric 26 has the transfer paper 24 with the photograph face 22 ironed thereon. An interface sheet 28 has a large circle 30 and a concentric inner small circle 32 formed thereon. A padding member 34 is provided. The piece of fabric 26 having the transfer paper 24 with the photograph face 22 is stacked upon the padding member 34 to form a face assembly 36. A mechanism 38 is for securing the face assembly 36 together using the large circle 30 on the interface sheet 28 as a guide. Excess material of the face assembly 36 is cut away from a stitch line 40 on the interface sheet 28, while a small disc 42 is removed from along the inner small circle 32 to form a circular aperture 44 to expose the photograph face 22. By manually urging the bottom of the padding member 34 upwardly the photograph face 22 on the transfer paper 24 on the piece of fabric 26 will go through the circular aperture 44 on the interface sheet 28 to reverse the interface sheet 28. A doll body 46 has a head 48 with a blank face 50. A mechanism 52 is for securing the cutaway face assembly 36 with the exposed photograph face 22 to the blank face 50 on the head 48 of the doll body 46.

The padding member 34 is comprised of DACRON material 54. The first securing mechanism 38 and the second securing mechanism 52 are both comprised of a needle 56 and a thread 58. The doll body 46 is comprised of a soft cloth padded composition 60.

Figure 11:
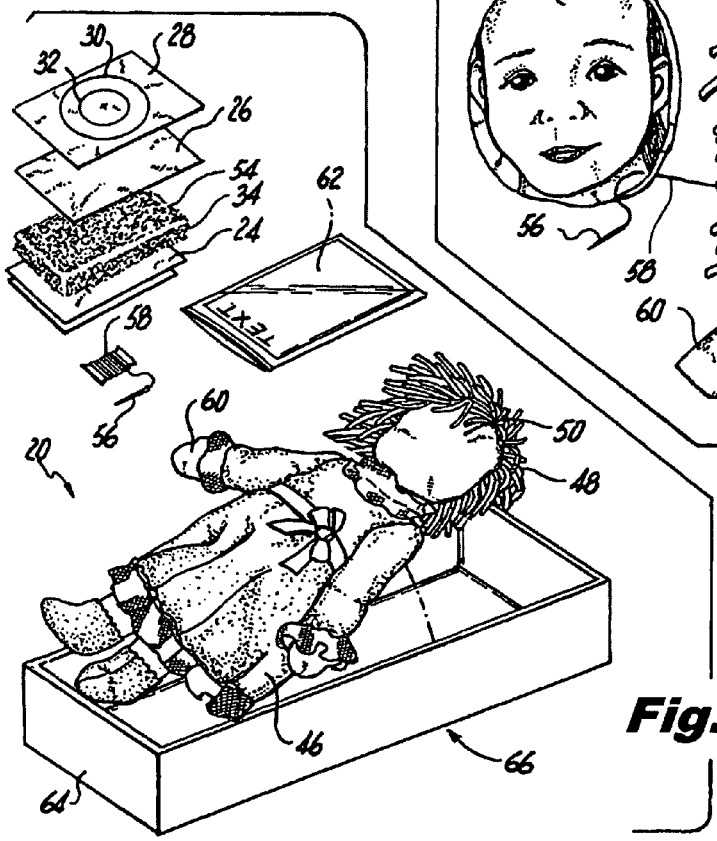
FIG. 11 is an exploded diagrammatic perspective view showing the various components of the present invention ready to be placed within a box for distribution as a kit.

As shown in FIG. 11, the personalized doll kit 20 further comprises a set of instructions 62 to guide a person in assembling the various components to form the personalized doll kit 20. The personalized doll kit 20 further comprises a box 64 to hold the various components and the set of instructions 62 therein for distribution as a kit 66.

Figure 12:
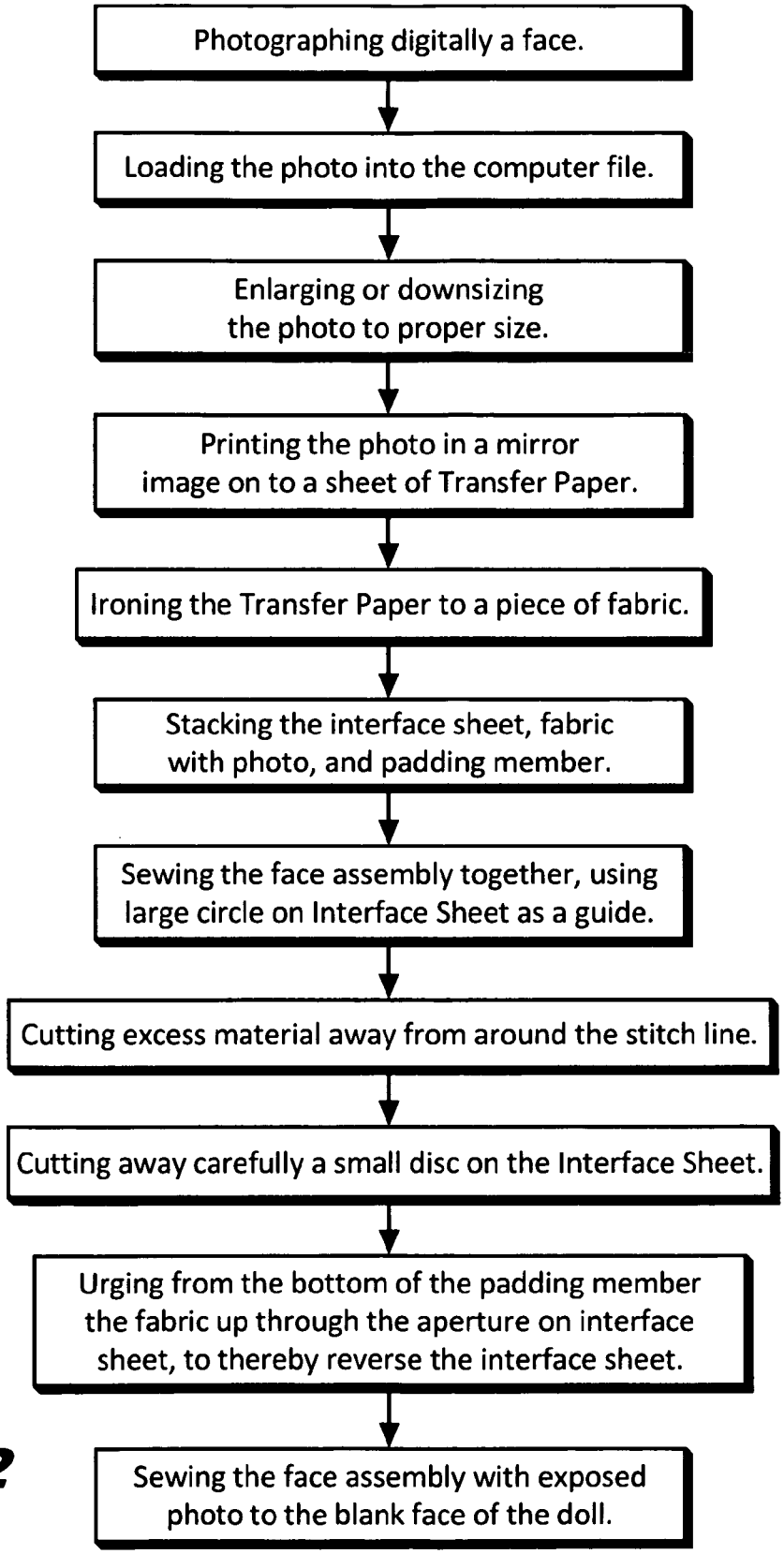
FIG. 12 is a flow chart diagram showing the various steps taken for assembling the present invention.

FIG. 12 shows a method of assembling the personalized doll 20 with computer generated photograph face 22 which comprises the following steps:

1. Photographing digitally the face.
2. Loading the photograph face 22 into a computer file.
3. Enlarging/downsizing the photograph face 22 to a proper size.
4. Printing the photograph face 22 in a mirror image onto the transfer paper 24 (See FIG. 3).
5. Ironing the transfer paper 24 with the photograph face 22 onto the piece of fabric 26 (See FIG. 4).
6. Stacking the interface sheet 28, the fabric 26 with the photograph face 22 and the padding member 34 to form the face assembly 36 (See FIG. 5).
7. Sewing the face assembly 36 together with needle 56 and thread 58, on the large circle 30 on the interface sheet 28 as a guide (See FIG. 6).
8. Cutting excess material of the face assembly 36 away from around the stitch line 40 on the interface sheet 28 (See FIG. 7).
9. Cutting away carefully the small disc 42 on the interface sheet 28 to form the circular aperture 44 when the small disc 42 is removed therefrom (See FIG. 8).
10. Urging from the bottom of the padding member 34 the fabric 26 with the photograph face 22 up through the circular aperture 44 on the interface sheet 28 to reverse the interface sheet 28 (See FIG. 9).
11. Sewing the cutaway face assembly 36 with exposed photograph face 22 to the blank face 50 on the head 48 of the doll body 46 (See FIG. 10).

It will be understood that each of the elements described above, or two or more together, may also find a useful application in other types of constructions differing from the types described above.

While the invention has been illustrated and described as embodiments of a personalized doll kit with computer generated photograph face, accordingly it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A personalized doll kit with computer generated photograph face which comprises:
   a) a transfer paper having said computer generated photograph face printed in a mirror image thereon;
   b) a piece of fabric having said transfer paper with said photograph face ironed thereon;
   c) an interface sheet having a large circle and a concentric inner small circle formed thereon;
   d) a padding member, wherein said piece of fabric having said transfer paper with said photograph face stacked upon said padding member forming a face assembly;
   e) means for sewing said face assembly together using said large circle on said interface sheet as a guide, whereby excess material of said face assembly is cut away from a stitch line formed by said large circle on said interface sheet, while a small disc is removed from said interface sheet along said inner small circle to form a circular aperture to expose said photograph face, wherein by manually urging the bottom of said padding member upwardly said photograph face on said transfer paper on said piece of fabric will go through said circular aperture on said interface sheet to reverse the remaining portion of said interface sheet;
   f) a doll body having a head with a blank face; and
   g) means for sewing said cutaway face assembly with said exposed photograph face to said blank face on said head of said doll body.

2. The personalized doll kit as recited in claim 1, wherein said padded member comprised DACRON material.

3. The personalized doll kit as recited in claim 1, wherein said first sewing means and said second sewing means both comprise a needle and thread.

4. The personalized doll kit as recited in claim 1, wherein said doll body is comprised of a soft cloth padded composition.

5. The personalized doll kit as recited in claim 1, further comprising a set of instructions to guide a person in assembling the various components to form said personalized doll kit.

6. The personalized doll kit as recited in claim 5, further comprising a box to hold the various components and said set of instructions therein for distribution as a kit~.

7. A personalized doll kit with computer generated photograph face which comprises:
   a) a transfer paper having said computer generated photograph face printed in a minor image thereon;
   b) a piece of fabric having said transfer paper with said photograph face ironed thereon;
   c) an interface sheet having a large circle and a concentric inner small circle formed thereon;
   d) a padding member, wherein said piece of fabric having said transfer paper with said photograph face stacked upon said padding member for form a face assembly;
   e) means for sewing said face assembly together using said large circle on said interface sheet as a guide, whereby excess material of said face assembly is cut away from a stitch line formed by said large circle on said interface sheet, while a small disc is removed from said interface sheet along said inner small circle to form a circular aperture to expose said photograph face, wherein by manually urging the bottom of said padding member upwardly said photograph face on said transfer paper on said piece of fabric will go through said circular aperture on said interface sheet to reverse the remaining portion of said interface sheet;

f) a doll body having a head with a blank face; and g) means for sewing said cutaway face assembly with said exposed photograph face to said blank face on said head of said doll body;

wherein said padded member comprised DACRON material; wherein said first sewing means and said second sewing means both comprises a needle and thread; wherein said doll body is comprised of a soft cloth padded composition; wherein said personalized doll kit further comprises a set of instructions to guide a person in assembling the various components to form said personalized doll; and wherein said personalized doll kit further comprises a box to hold the various components and said set of instructions therein for distribution as a kit.

8. A method of assembling a personalized doll with computer generated photograph face comprising the steps of:

a) photographing digitally the face;

b) loading the photograph face into a computer file;

c) enlarging/downsizing the photograph face to a proper size;

d) printing the photograph face in a mirror image onto a transfer paper;

e) ironing the transfer paper with the photograph face onto a piece of fabric;

f) stacking an interface sheet, the fabric with the photograph face and a padded member to form a face assembly;

g) sewing the face assembly together with needle and thread, on a large circle on the interface sheet as a guide;

h) cutting excess material of the face assembly away from around a stitch line formed by said large circle on the interface sheet;

i) cutting away carefully a small disc on the interface sheet to form a circular aperture when the small disc is removed therefrom;

j) urging from the bottom of the padding member the fabric with the photograph face up through the circular aperture on the interface sheet to reverse the remaining portion of the interface sheet; and k) sewing the cutaway face assembly with exposed photograph face to a blank face on a head of a doll body.

* * * * *